United States Patent [19]

Wilbur, Jr.

[11] Patent Number: 4,592,303

[45] Date of Patent: Jun. 3, 1986

[54] PASTE MATERIAL DISPENSING DEVICE

[75] Inventor: Leonard P. Wilbur, Jr., Lancaster, Pa.

[73] Assignee: RCA Corporation, Princeton, N.J.

[21] Appl. No.: 654,486

[22] Filed: Sep. 26, 1984

[51] Int. Cl.[4] ..... B05C 5/02

[52] U.S. Cl. ..... 118/409; 118/321; 118/503

[58] Field of Search ..... 118/503, 409, 321, 320

[56] References Cited

U.S. PATENT DOCUMENTS

| | | | |
|---|---|---|---|
| 2,880,697 | 4/1959 | Blanding et al. | 118/320 |
| 3,339,522 | 9/1967 | Shaffer et al. | 118/320 X |
| 3,492,146 | 1/1970 | Kornaker | 118/409 X |
| 3,575,131 | 4/1971 | Lohmann | 118/321 X |
| 4,048,951 | 9/1977 | Tamura | 118/321 X |
| 4,137,341 | 1/1979 | Adachi | 427/64 |
| 4,194,463 | 3/1980 | Kimbrough et al. | 118/409 |

*Primary Examiner*—John P. McIntosh

*Attorney, Agent, or Firm*—E. M. Whitacre; D. H. Irlbeck; L. L. Hallacher

[57] ABSTRACT

A frit dispensing device includes a hopper which dispenses the frit material to the seal edge of a CRT funnel. The device centers the funnel and raises the funnel to place the seal edge in a reference plane a desired distance from the hopper. Funnel orientation members engage the funnel to place the funnel in the desired orientation with respect to the hopper. The funnel is rotated beneath the hopper and frit material is uniformly dispensed to the entire seal edge.

11 Claims, 6 Drawing Figures

PASTE MATERIAL DISPENSING DEVICE

BACKGROUND

This invention relates generally to paste material dispensing devices and particularly to a system for uniformly dispensing frit material to a seal edge of a funnel portion of a CRT (cathode ray tube).

A CRT envelope is composed of a faceplate panel and a funnel portion. A phosphor screen is provided on the inside surface of the faceplate panel and luminesces when impacted by electrons to produce a visual output. The funnel portion includes a neck to support the electron gun which provides the electrons to scan the phosphor screen. The funnel portion and faceplate panel must be permanently and hermetically joined to permit evacuation of the envelope as required for operation of the CRT. The panel and funnel are each provided with mating seal edges along which they are joined. A vitrifiable material is placed continuously along one of the seal edges. The funnel is placed in a carrier and the panel is placed in the funnel with the mating seal edges aligned. The carrier supports the funnel and panel as they pass through an oven which is raised to high temperature to vitrify the frit material to permanently and hermetically join the two components.

Typically the frit material is applied to the sealing edge of the funnel by rotating the funnel at a constant rotating speed. A frit material dispenser is pivotably arranged above the seal edge and the uniform dispensation of the frit material requires the dispenser to remain a constant distance from the funnel as the funnel rotates. The dispenser includes a follower to retain the dispenser above the seal edge as the funnel rotates. For these reasons, it is important for the seal edge to be located in a reference plane and to be properly oriented and centered with respect to the outlet orifice of the dispenser. The present invention fulfills these important requirements.

CROSS REFERENCE TO RELATED APPLICATION

The present invention can be used with the invention described in application Ser. No. 654,485 entitled "SYSTEM FOR UNIFORMLY DISPENSING PASTE MATERIAL TO A SEAL EDGE" filed on an even date herewith by Leonard P. Wilbur, Jr. and Wallace B. Anthony.

SUMMARY

A device for dispensing a paste material onto an edge of an object includes a support plate. A plurality of reference members is supported by the support plate to define a reference plane a preselected distance from the plate. A plurality of positioning members is supported by the support plate. The positioning members are arranged to engage the object and urge the object into a desired location and orientation with respect to the support plate. A centering member receives the object at a position substantially centered with respect to the reference numbers and the positioning members. The centering member is moveable in a direction substantially normal to the reference plane whereby the centering member receives the object and moves the edge into engagement with the reference members to accurately position the edge in the reference plane. A hopper stores and dispenses the paste material onto the edge. The hopper includes a follower for engaging the side of the object in the proximity of the edge whereby the hopper accurately follows the edge and dispenses the paste material onto the edge as the device is rotated.

DETAILED DESCRIPTION

Figure 1:
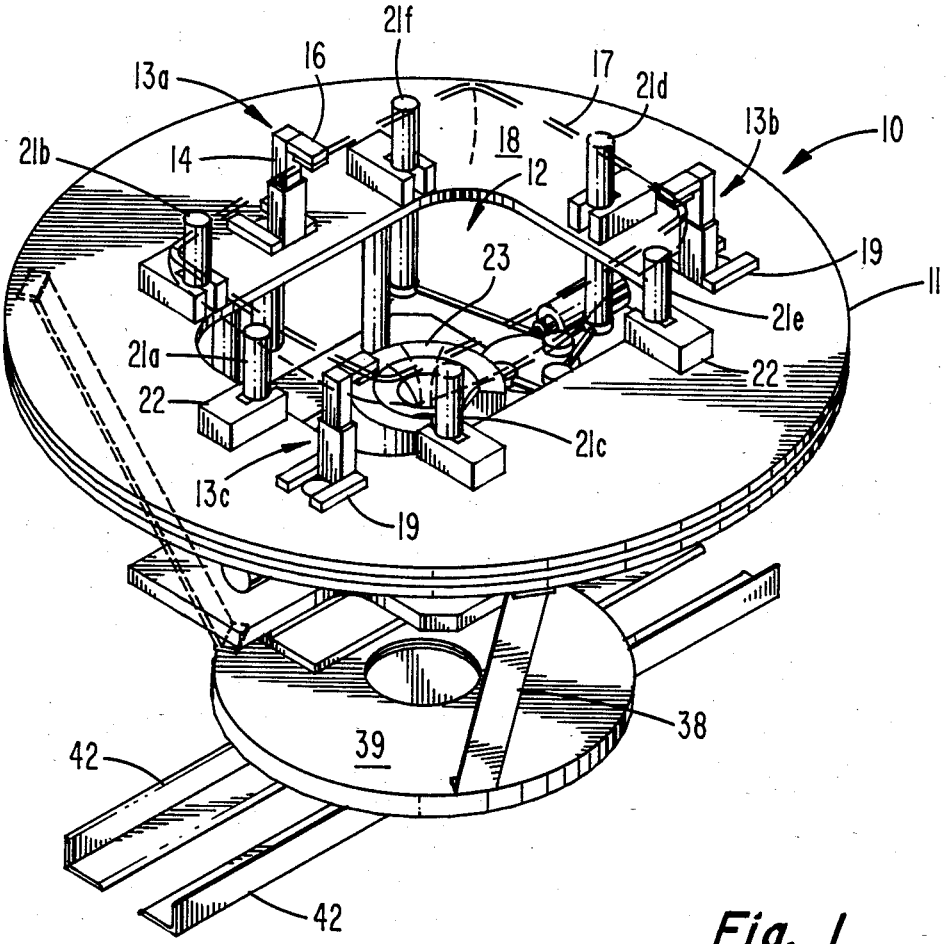
FIG. 1 is a perspective view of a preferred embodiment.
Figure 2:
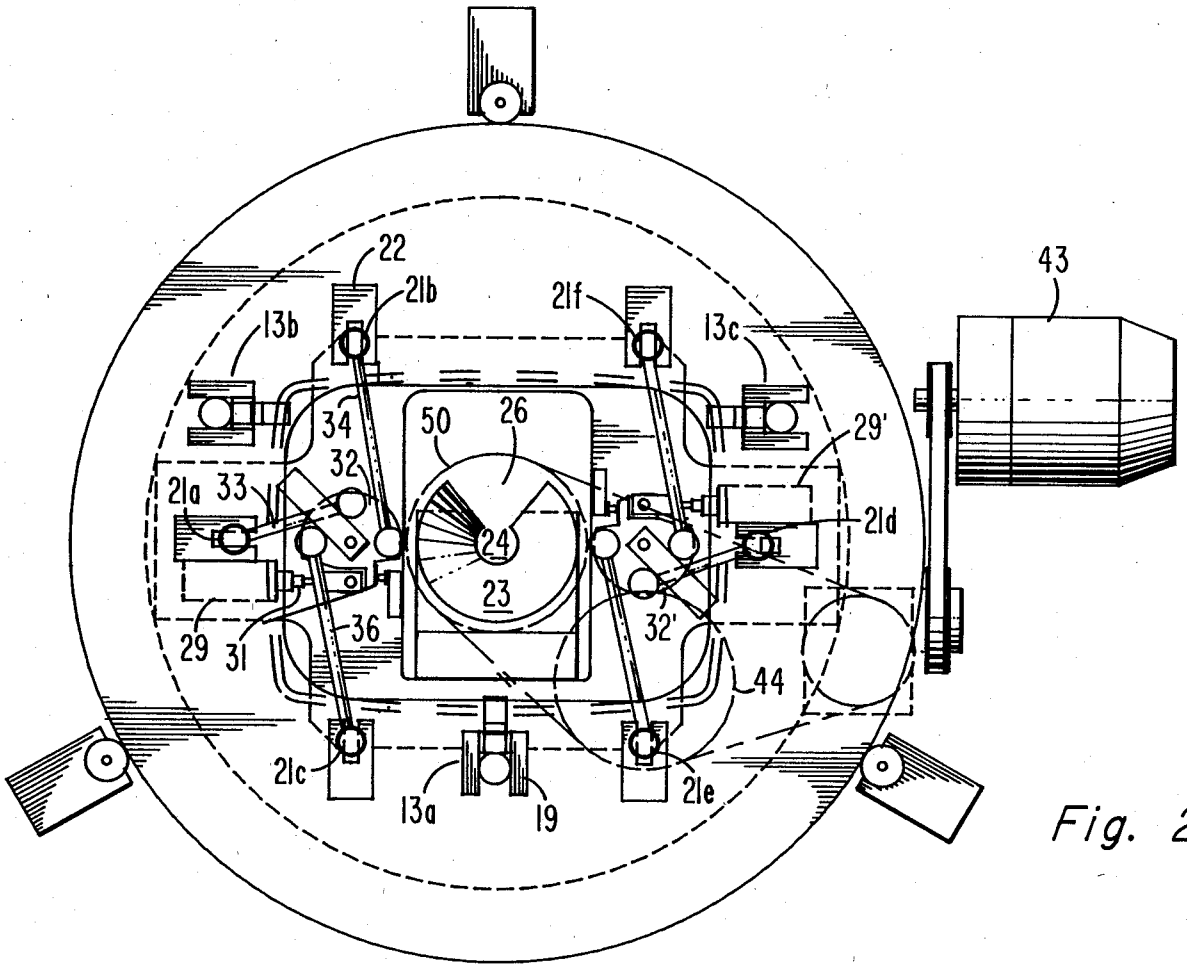
FIG. 2 is a top view of the preferred embodiment of FIG. 1.

FIGS. 1 and 2 show a paste material dispensing device 10 that includes a support plate 11 having a centered aperture 12. A plurality of reference members 13*a*, 13*b*, 13*c*, are supported by the support plate 11. Each of the reference members includes a vertical arm 14 which extends generally perpendicular to the plane of the support plate 11 and a horizontal arm 16 which extends from the distal end of the arm 14 substantially parallel to the plane of the support plate 11. The substantially horizontal arms 16 are all precisely arranged substantially the same distance from the upper surface plane of the support plate 11 so that the bottom surfaces of the arms 16 form a reference plane which engages the sealing edge 17 of a funnel 18, shown in phantom. The vertical arms 14 of the referencing members 13 are pivotably coupled to support blocks 19 which are fixed to the support plate 11. The referencing arms 16 thus are retractable away from the seal edge 17 to permit the uniform distribution of frit material onto a seal edge.

A plurality of positioning members 21*a* to 21*f* are pivotably coupled to support blocks 22 which are fixed to the support plate 11. The positioning members 21*a* to 21*f* extend generally perpendicular to the plane of the support plate 11. The positioning members 21*a* to 21*f* are arranged to engage all sides of a CRT funnel which is placed into the device 10. Initially the positioning members are tilted outwardly away from the center of the device 10. A funnel placed in the device 10 rests inside the positioning members 21*a* to 21*f* but typically has no specific orientation. The positioning members 21*a* to 21*f* close inwardly toward the funnel to engage the sides of the funnel and urge the funnel into a particular orientation.

Figure 5:
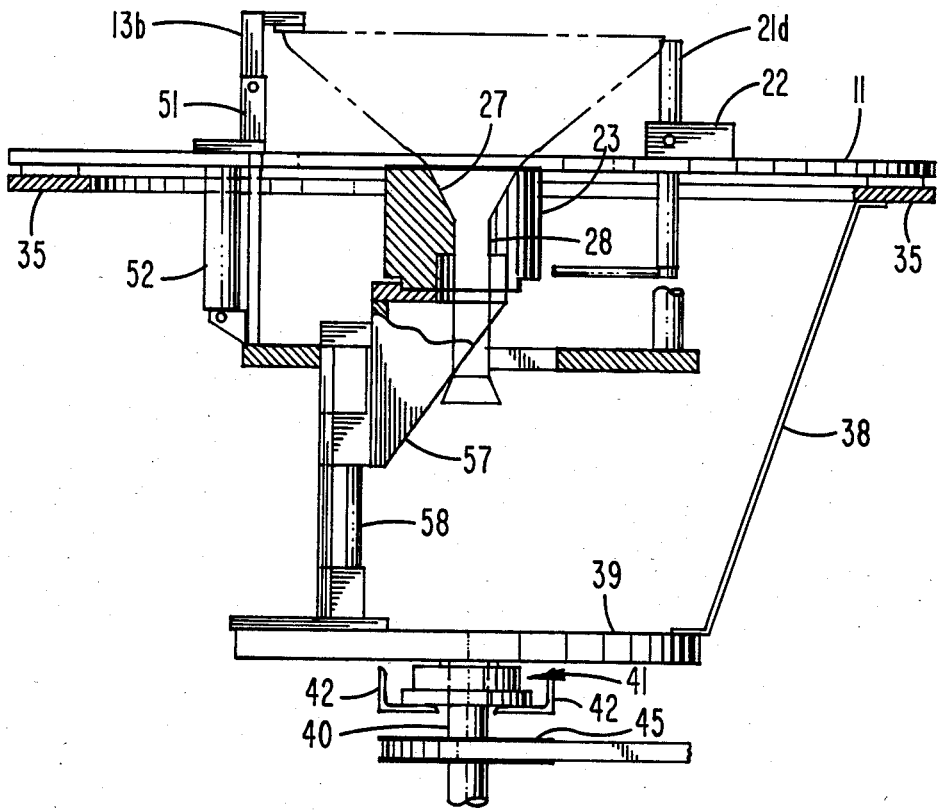
FIG. 5 shows the centering member in more detail.

A substantially cylindrical centering member 23 is arranged at the center of the device 10 below the support plate 11. In FIG. 2, the centering member 23 includes a centered bore 24 communicating with a wedge-shaped opening 26. In FIG. 5, the upper portion 27 of the center bore 24 (FIG. 2) which is the most proximate to the support plate 11, is funnel shaped at substantially the same angle as the funnel of the CRT to be received by the centering member. The lower straight portion 28 of the bore 24 is substantially larger than the neck of the funnel whereby the centering member 23 receives a funnel and centers the funnel in the device 10. The wedge-shaped opening 26, permits the easy removal and insertion of funnels.

Figure 3:
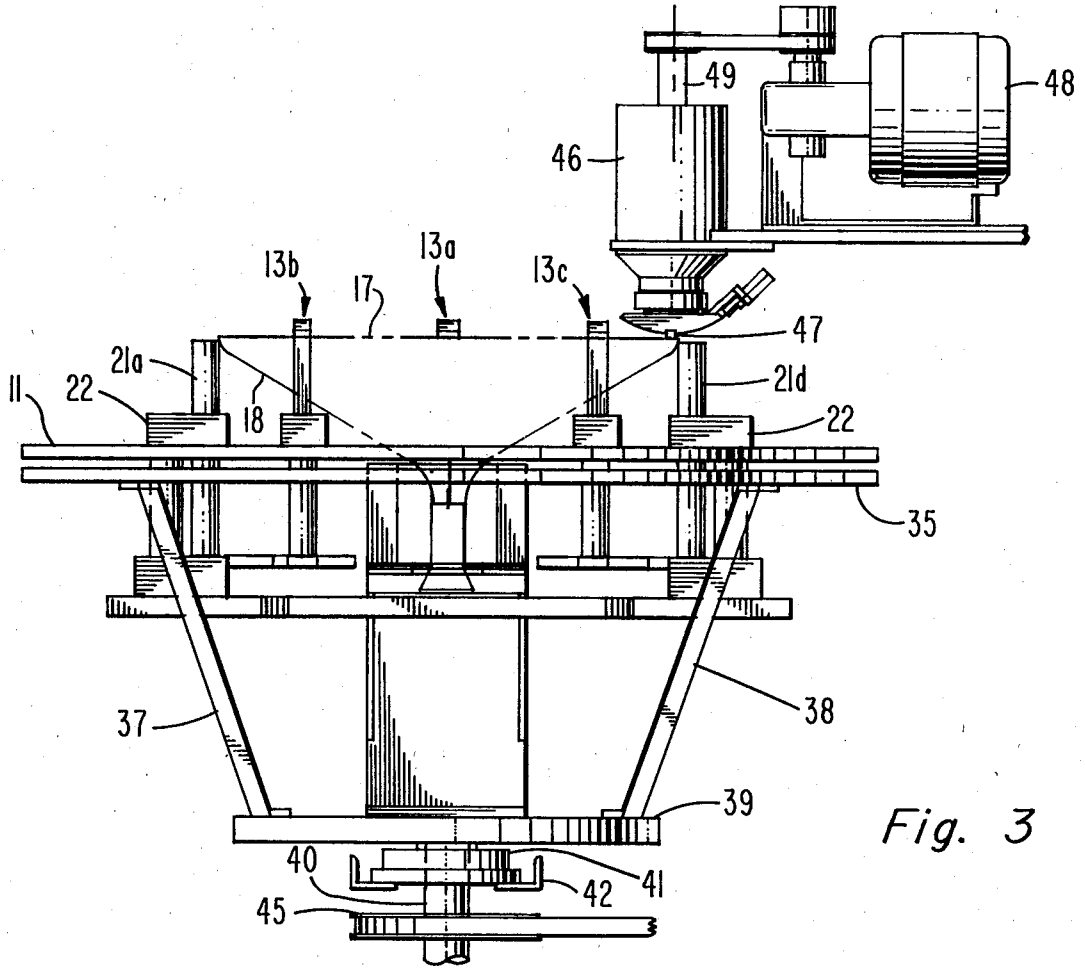
FIG. 3 is a side view of the preferred embodiment of FIG. 1.

In FIGS. 2 and 3, the positioning members 21*a* to 21*f* extend beneath the support plate 11. In FIG. 2, a cylinder 29 includes a shaft 31 coupled to a rotatable member 32. Three connecting rods 33, 34 and 36 are pivotably coupled to the rotatable member 32. The other end of the connecting rods 33, 34 and 36 are respectively connected to the positioning members 21*a*, 21*b*, and 21*c* at the lower portion of the members. Accordingly, actuation of the cylinder 29 rotates the rotatable member 32 causing the connecting rods 33, 34 and 36 to linearly move and tilt the positioning members. The positioning members 21*d*, 21*e*, and 21*f* are similarly actuated by use of a cylinder 29' and a rotatable member 32'.

In FIG. 3, the support plate 11 is coupled to a parallel lower plate 35. The lower plate 35 is coupled by appropriate braces 37 and 38 to a baseplate 39. The baseplate 39 is supported through a bearing arrangement 41 by support members 42. A shaft 40 is fixed to the baseplate 39 and passes through the bearing 41. A pulley 45 is coupled to the shaft 40. A motor 43 (FIG. 2) is appropriately coupled to the pulley 45 to rotate the device 10. Additionally, a pulse generator 44 of known type is rotated by the motor 43 to produce a particular number of output pulses for each increment of rotation. For example, one pulse can be generated for each degree of rotation.

In FIG. 3, a hopper 46, of known type, includes an outlet orifice 47 positioned immediately above the seal edge 17 of the funnel 18. The hopper 46 is permanently positioned above the support plate 11 and is free to move horizontally. A motor 48 drives an auger 49 to feed frit material from the hopper onto the seal edge at a rate determined by the speed of rotation of the motor 48. The speeds of the motors 43 and 48 are synchronized and controlled in a manner fully described in application Ser. No. 654,485 referenced hereinabove.

Figure 4:
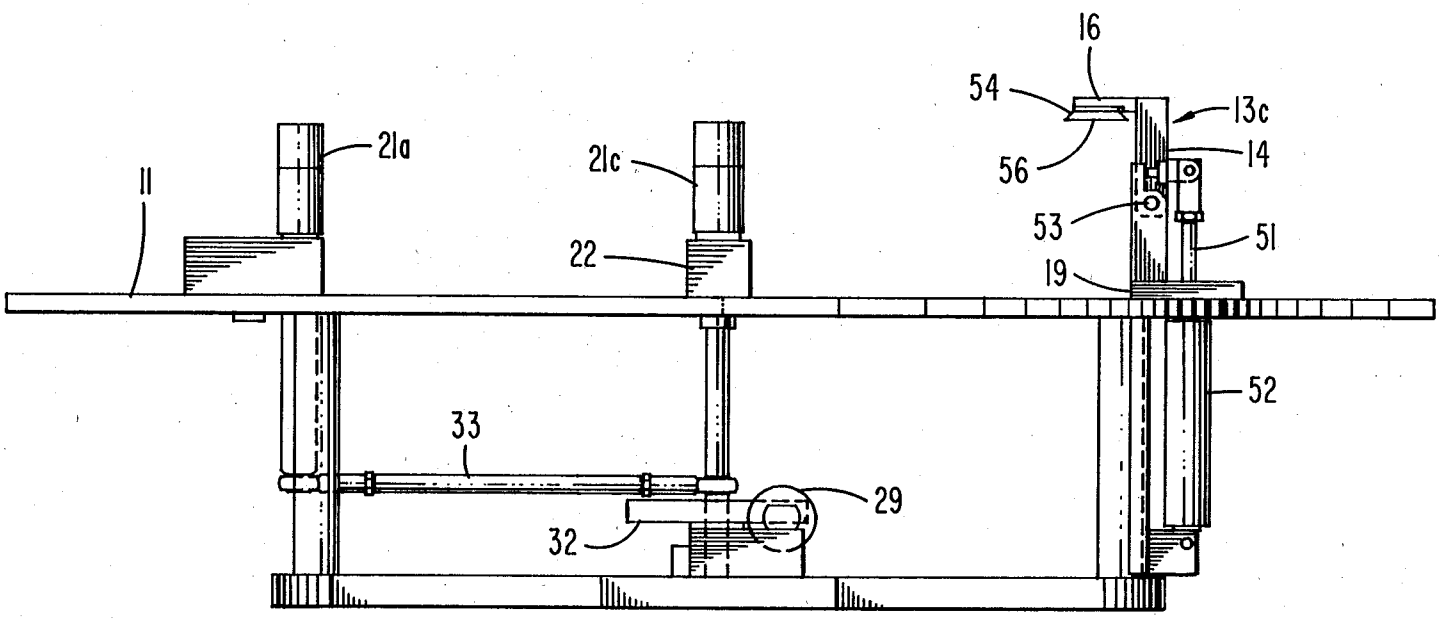
FIG. 4 shows the reference numbers and the positioning members in more detail.

FIG. 4 shows the reference members 13*a* to 13*c* in more detail. A shaft 51 of a pneumatic cylinder 52 is pivotably coupled to the vertical arm 14 of the reference member 13*c*. Upon retraction of the shaft 51 into the cylinder 52, the vertical arm 14 pivots about a pivot point 53 to retract the horizontal arm 16 from the seal edge of a funnel in the device 10. A pad 54, which is made from an unyielding material but which will not mar the seal edge, is attached to the horizontal arm 16 of the referencing member 13*c*. An exposed referencing surface 56 of the pad 54 thus engages the seal edge. Accordingly, all the reference members 13*a* to 13*c* include a similar reference pad positioned at precisely the same distance from the upper surface of the support plate 11.

In FIG. 5, the centering member 23 is supported by a bracket 57. The bracket 57 is vertically slidable on a shaft 58 which is supported by the baseplate 39. Accordingly, the centering member 23 receives a funnel when in a lowered position and is then raised upwardly until the seal edge of the funnel engages the referencing surfaces 56 of the referencing members 13*a*, 13*b*, and 13*c*. The referencing members 13*a*, 13*b*, and 13*c* thus serve to ensure that the seal edge is raised to the proper height and to also ensure that the funnel is not tilted in the centering member 23 so that the entire seal edge lies in the referencing plane defined by the referencing surfaces of the referencing members.

Figure 6:
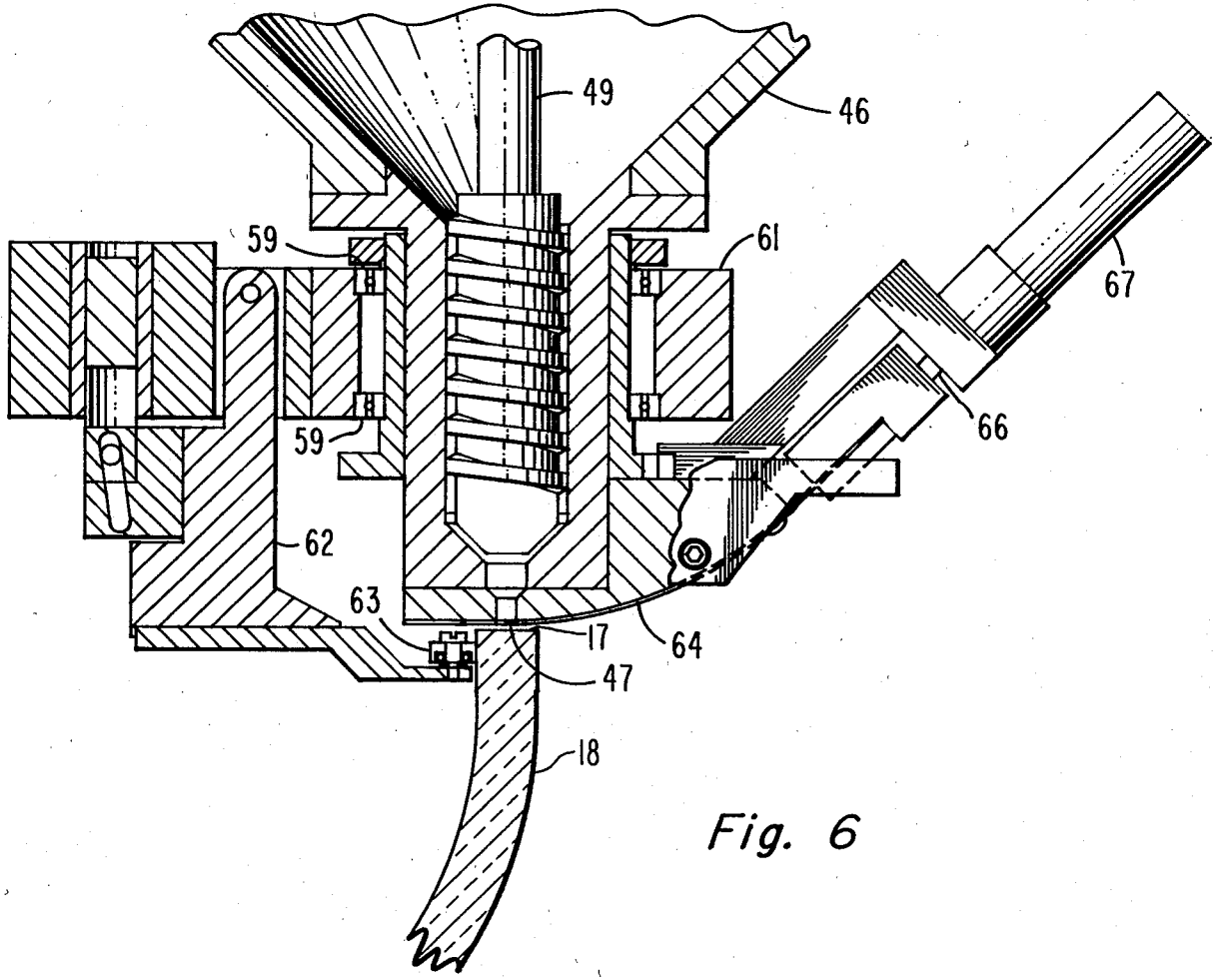
FIG. 6 is a cross-section of a portion of the hopper and paste shearing mechanism.

In FIG. 6, annular bearings 59 are arranged about the hopper 46. The bearings 59 support a ring 61 which is free to rotate about the longitudinal axis of the hopper 46. A linkage member 62 is pivotably coupled to the ring 61 and supports a follower 63. The disc-shaped follower 63 is rotatable on the linkage member 62 and engages the inside surface of the funnel 18 so that the outlet orifice 47 of the hopper 46 remains positioned above the seal edge 17 as the funnel is rotated during operation of the motor 43.

The end of the hopper 46, which contains the outlet orifice 47, is curved and is machined to receive a resilient blade 64. The blade 64 includes an aperture which normally is aligned with the outlet orifice 47 of the hopper 46. The resilient blade 64 is coupled to the shaft 66 of a cylinder 67. After a continuous bead of frit material has been placed around the seal edge 17 of the funnel 18, the cylinder 67 is actuated and the resilient blade 64 rapidly closes the outlet orifice 47 to cleanly shear the dispensed bead of material from the supply of material within the hopper 46.

In operation, a funnel is placed into the device 10 by inserting the neck of the funnel into the bore 24 of the centering member 23. The centering member 23 is raised upwardly and the seal edge 17 engages the reference pads 54 of the reference members 13*a*, 13*b* and 13*c*. The positioning members 21*a* to 21*f* are moved inwardly to engage the sides of the funnel and rotate the funnel about the longitudinal axis of the funnel neck. The funnel is thus urged into the desired orientation within the device 10. The referencing members 13*a*, 13*b* and 13*c* are pivoted away from the seal edge 17 of the funnel 18 permitting a continuous bead of frit material to be applied to the seal edge 17. The hopper 46 is arranged at a predetermined position with respect to the suport plate 11. Accordingly, the dispensation of frit material onto the seal edge begins at the same place on all panels. The motors 43 and 48 are actuated and the motor 43 makes one complete revolution and the entire seal edge 17 of the funnel receives a continuous bead of frit material as the lead screw 49 feeds the frit material through the exit orifice 47. The linkage member 62 is mounted to the frit dispenser 46 by the bearings 59 and, therefore, is free to rotate about the dispenser. For this reason, the follower 63 follows the inside surface of the funnel 18 while maintaining the exit orifice 47 in the desired position above the seal edge. After a complete bead of frit material is placed around the complete seal edge, the cylinder 67 is actuated and the resilient blade 64 shears the bead of frit material away from the supply of material within the hopper 46. This shearing eliminates the long, gradually narrowing tail which is ordinarily produced when a bead of paste is separated from a supply.

What is claimed is:

1. A device for dispensing a paste material onto an edge of an object comprising:

a support plate;

a plurality of reference members supported by said support plate, said reference members defining a reference plane a preselected distance from said support plate, each of said reference members including two angularly disposed arms, one of said arms being pivotably coupled to said support plate and the other of said arms defining said reference plane when said reference members are in a referencing position;

a plurality of positioning members supported by said support plate, said positioning members being arranged to engage said object to urge said object to a desired location and orientation with respect to said support plate;

centering means for receiving said object at a position substantially centered with respect to said reference members and said positioning members, said centering means being moveable in a direction substantially normal to said reference plane whereby said centering means receives said object and moves said edge into engagement with said reference members to accurately position said edge in said reference plane; and hopper means arranged at a predetermined position with respect to said support plate, for storing and dispensing said paste material onto said edge, said hopper means including a follower for engaging the side of said object in the proximity of said edge whereby said hopper accurately follows said edge and dispenses said paste material onto said edge as said support plate is rotated.

2. The device of claim 1 wherein said object is a funnel for a kinescope whereby said edge is the seal edge of said funnel and said paste is frit material, and wherein said reference members are retractable from said seal edge to permit the uniform dispensation of frit material onto said edge.

3. The device of claim 2 further including means for separating dispensed frit material from said hopper, said means for separating including a flexible blade having an aperture aligned with the exit orifice of said hopper, and means for moving said blade over said exit orifice.

4. The device of claim 3 wherein said means for moving is a fluid cylinder.

5. The device of claim 1 wherein said positioning members are tiltably supported by said support plate whereby said positioning members are tilted into engagement with said funnel to urge said funnel into a preselected orientation with respect to said support plate.

6. The device of claim 5 wherein said centering means normally lies below said reference plane and moves upwardly to engage said seal edge with said other arms of said reference members.

7. The device of claim 6 wherein said centering means is substantially funnel shaped internally to receive the neck of said funnel.

8. The device of claim 7 wherein said hopper is pivotably arranged above said support plate, and further including a follower rotatably coupled to said hopper, said follower being positioned to engage at least one side of said funnel in the proximity of said seal edge whereby said follower positions said hopper above seal edge as said support plate is rotated.

9. The device of claim 8 wherein said follower is a rotatable disc.

10. The device of claim 9 further including means for separating dispensed frit material from said hopper, said means for separating including a flexible blade having an aperture aligned with the exit orifice of said hopper, and means for moving said blade over said exit orifice.

11. The device of claim 10 wherein said means for moving is a fluid cylinder.

* * * * *